United States Patent [19]

Gien

[11] Patent Number: 4,610,314

[45] Date of Patent: Sep. 9, 1986

[54] TRUCK MOUNTED DRILLING MACHINE

[76] Inventor: Bernard L. Gien, P.O. Box 471, Edenvale, 1610, South Africa

[21] Appl. No.: 692,938

[22] Filed: Jan. 18, 1985

[30] Foreign Application Priority Data

Sep. 7, 1984 [ZA] South Africa ..... 84/7043

[51] Int. Cl.[4] ..... E21B 7/02; E21C 11/02

[52] U.S. Cl. ..... 175/57; 175/122; 175/203; 173/22; 173/25

[58] Field of Search ..... 175/57, 122, 162, 202, 175/203; 173/22, 25

[56] References Cited

U.S. PATENT DOCUMENTS

| | | | |
|---|---|---|---|
| 1,241,931 | 10/1917 | Davis | 175/162 |
| 2,414,072 | 1/1947 | Taft | 173/25 X |
| 2,856,156 | 10/1958 | Young | 175/203 |
| 2,904,310 | 9/1959 | Leonard | 175/122 |
| 3,181,623 | 5/1965 | Lindgren | 173/22 |
| 3,205,627 | 9/1965 | Gyoneyosi | 173/22 X |
| 3,789,931 | 2/1974 | Quinn | 173/22 |

*Primary Examiner*—Stephen J. Novosad
*Assistant Examiner*—Thuy M. Bui
*Attorney, Agent, or Firm*—Abelman Frayne Rezac & Schwab

[57] ABSTRACT

A drilling machine comprises a rotary motor mounted to an assemblage of rigid bar linkages. Means are provided for moving the linkages relative to each other. The linkages are connected together in a configuration which ensures that as the linkages move relative to each other the rotary motor moves along a vertical line. Preferably the machine will be mounted on a suitable vehicle. The invention extends to a method of drilling.

5 Claims, 3 Drawing Figures

TRUCK MOUNTED DRILLING MACHINE

This invention relates to a drilling machine.

One type of prior art drilling machine known to applicant comprises a columnar like frame structure rig which can be orientated in a vertical orientation and has a rotary drive means which slides up and down rails fixed to the rig. The rotary drive means is in use moved up and down the rails by means of a mechanical or hydraulic arrangement. The rotary drive means is used to rotate drill rods and the mechanical or hydraulic arrangement is used to urge the drive means up or down. When not in use the rig may be manipulated to a horizontal orientation in order that the vehicle whereon the rig is mounted may be moved around.

It will be appreciated that the entire arrangement is fairly cumbersome and complex and consequently machines of this nature tend to require substantial maintenance and are expensive to run.

A further problem with prior art machines of this nature occurs when adding further drill rod sections to the drill string, or when dismantling a drill string after a drilling operation. The present methods of handling individual drill rod sections entail a substantial amount of manual manipulation which is both time consuming and labour intensive.

Generally drilling machines of this nature are mounted on the back of trucks, trailors or other similar vehicles. Rail vehicles and slides are also utilized. The term "vehicle" when used in this specification will mean any suitable means which will allow a drilling machine mounted thereon to be moved around.

It is an object of this invention to provide a drilling machine which has an efficient and effective drilling action.

A further object of the invention is to provide a mechanism for handling drill rod sections.

According to the invention there is provided a drilling machine comprising a rotary motor mounted to an assemblage of rigid bar linkages adapted to impart straight-line motion to the rotary motor such that on movement of the linkages in use, the rotary motor moves along a vertical line, and means for moving the linkages relative to each other.

Further there is provided for the assemblage of linkages to define a "Scott-Russell" type straight-line mechanism or a "lazy-tong" type mechanism. Other mechanisms are also envisaged.

Further there is provided for the means of moving the linkages to comprise an hydraulic piston and cylinder assembly. Preferably the piston and cylinder assembly is connected to two linkages in a manner adapted to impart a constant rate of movement to the rotary motor along the vertical line. The drilling machine will preferably be mounted to a vehicle.

A further aspect of the invention provides for a method of drilling comprising the steps of:

1. stacking a plurality of drill rod sections in convenient holder;
2. engaging an end of one drill rod section with a rotary motor movable into and out of engagement with an end of the drill rod sections;
3. lifting the drill rod section into operative orientation with linkages to which the rotary motor is mounted;
4. using the drill rod section to drill a hole; and
5. repeating steps 2 to 3 with subsequent drill rod sections The drill rod sections may be replaced in the holder after drilling by substantially reversing steps 2 and 3.

These and further features of the invention will be made more apparent from the description of a preferred embodiment thereof given below by way of example. In the description reference is made to the accompanying drawings in which.

Figure 1:
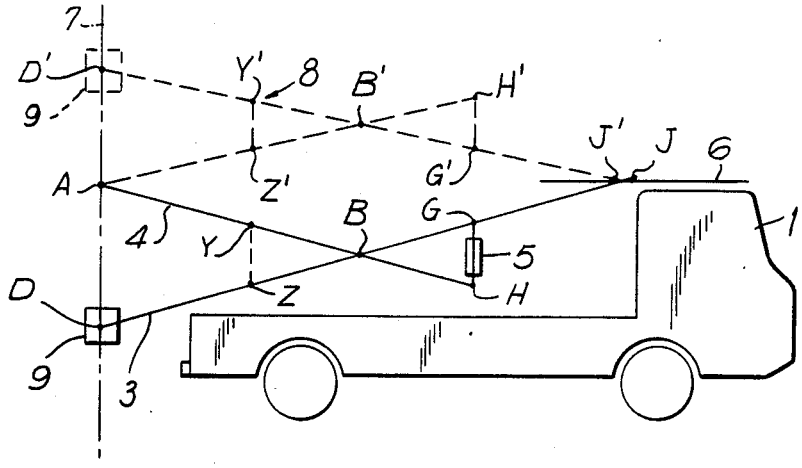
FIG. 1 shows in diagramtic form a first vehicle mounted drilling machine.

Referring initially to FIG. 1, a vehicle mounted drilling machine is shown comprising a flat bed truck 1 having a drilling rig 2 mounted thereon. The drilling rig 2 comprises first and second linkages numbered 3 and 4 respectively. The linkages define a "lazy-tongs" type mechanism The first linkage 3 extends between points "D" and "J" on the diagram and has a mid-point "B". The two linkages 3 and 4 are pivotally connected together at point B. The second linkage 4 extends between point "A" and "H" on the diagram and an hydraulic ram 5 connects the first and second linkages together at points "H" and "G" on the first and second linkages respectively. Alternatively the ram can be mounted between points "Y" and "Z" in FIG. 1. The hydraulic ram assembly is adapted to move the linkages relative to each other Point "A" on the second linkage 4 is a point which is fixed relative to the truck 1. The second linkage 4 is thus pivotable about point "A" The point "J" on the first linkage lies on a slide 6 which is at the same elevation as point A and which when the two linkages move relative to each other the point "J" will slide on the slide or slides 6. With a configuration as described herein, the point "D" will, when the two linkages move in a vertical plane relative to each other, move along a vertical line 7. The dotted lines 8 in FIG. 1 show the linkages in a different position of movement and one where the point "D" has moved up the line 7 to point "D'".

In use a rotary motor suitable for drilling operations will be mounted to the first linkage at point "D". A drill rod will then be connected to the rotary motor 9 when the motor is at a position "D'" as shown in the diagram. The rotary motor will be urged downwardly whilst rotating the drill rod and this way a vertical hole will be bored downwardly.

Figure 2:
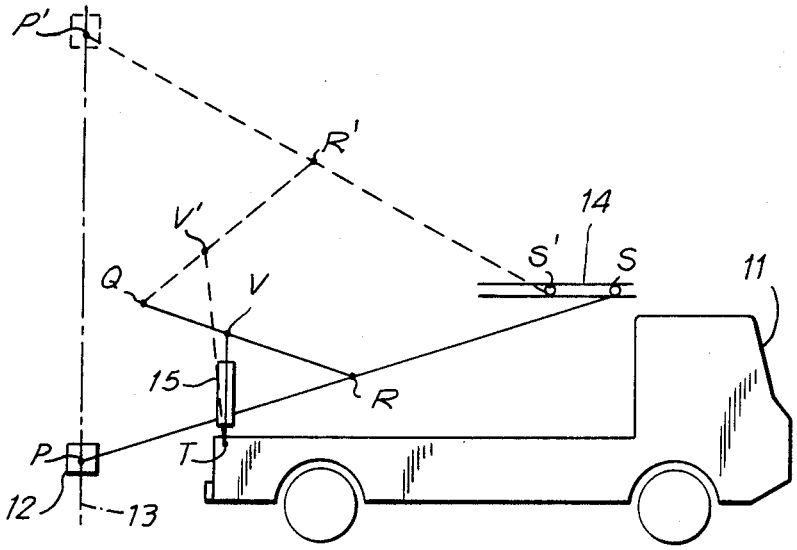
FIG. 2 shows a second embodiment.

Referring now to FIG. 2 a similar type mechanism is shown also mounted to the back of a flat bed truck 1 and also adapted to move a rotary drilling machine 12 along a vertical line 13. The mechanism is known as a "Scott-Russel" type mechanism. In this second assemblage of linkages, the point "Q" is fixed relative to the truck 11 and the point "S" is located in a slide or slides 14 which is also fixed relative to the truck 11. An hydraulic ram 15 acts between points "T" and "V" is used to manipulate the linkages. The linkages will be used for drilling operations in substantially the same manner as that described with reference to FIG. 1.

One advantage of locating the hydraulic ram assembly in a position as shown in FIG. 1 is that a constant rate of expansion or retraction of the ram will produce a corresponding constant rate of movement of the rotary motor 9. It is important when drilling that the thrust of the drilling machine is substantially constant and for this reason the linkage assembly as shown in FIG. 1 is considered to be highly effective. Clearly however the linkage and hydraulic ram assembly can be adapted to provide a substantially constant rate of movement for the rotary motor 12 shown in FIG. 2.

Figure 3:
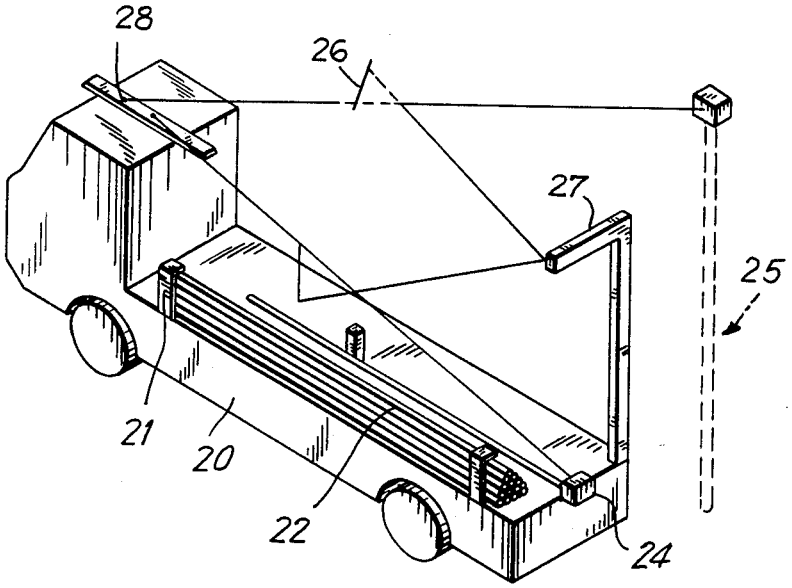
FIG. 3 shows an embodiment of the invention in use lifting drill rod sections into position.

Referring to FIG. 3, a flat bed truck 20 having an arrangement of linkages substantially similar to that as shown in FIG. 1 is shown. On the back of the truck a plurality of holders 21 are mounted between which a plurality of drill rod sections 22 are located. Each of the drill rod sections is adapted to be engaged by a rotary motor 24 and to be lifted as shown at dotted lines 25. The hydraulic ram 26 is used to manipulate linkages 27 in order to lift or lower the rotary motor 24. The linkages are affixed to a rigid arm 27 and the linkages slide on a slide member 28. The mechanism shown in FIG. 3 is similar to that of FIG. 1.

Clearly when a drill string is disassembled, the individual drill rod sections will be individually separated from the remainder of the drill string and located on the back of the truck between holders 21. The linkages will be used to lower the drill rod sections into position on the back of the truck.

There may be many variations to the above described embodiment without departing from the scope of the invention. In particular, it is envisaged that linkages may be connected together in different configurations which will also give a straight-line motion to the rotary motor. Also the overall shape and relative lengths of the linkages may be varied as required.

I claim:

1. A vehicle mounted drilling machine, comprising:

an assemblage of rigid bar links mounted on said vehicle and supporting a rotary motor of said drilling machine, said linkages including;

a first rigid bar link pivotally supported on said vehicle at one end of said first bar link;

a second rigid bar link pivotally connected intermediate its ends to the other end of said first bar link;

means supporting said rotary motor from one end of said second bar link;

means guiding the other end of said second bar link for linear movement in a horizontal plane including the pivotal axis of said one end of said first link; and, means for varying the included angle between said first and second bar links;

whereby, upon movement of said links relative to each other, said rotary motor is moved along an axially straight verticle line.

2. A drilling machine as claimed in claim 1 wherein the rigid bar linkages define a "Scott-Russell" type straight line mechanism.

3. A drilling machine as claimed in claim 1 wherein the rigid bar linkages define a "lazy-tongs" type mechanism.

4. A drilling machine according to claim 1 wherein the means for moving the linkages relative to each other comprises an hydraulic piston and cylinder assembly.

5. A drilling machine as claimed in claim 4 wherein the piston and cylinder assembly is adapted to impart a constant rate of movement to the rotary motor along the vertical line in use.

* * * * *